US008505123B2

(12) United States Patent
Kennedy et al.

(10) Patent No.: US 8,505,123 B2
(45) Date of Patent: Aug. 13, 2013

(54) VENTILATED TOILET

(75) Inventors: James Kennedy, Geraldton (CA); Ross Roderick Kennedy, Longlac (CA)

(73) Assignee: Havilah Holdings (Thunder Bay) Corp., Geraldton, Ontario (CA)

( * ) Notice: Subject to any disclaimer, the term of this patent is extended or adjusted under 35 U.S.C. 154(b) by 24 days.

(21) Appl. No.: 12/758,418

(22) Filed: Apr. 12, 2010

(65) Prior Publication Data

US 2010/0257669 A1 Oct. 14, 2010

Related U.S. Application Data

(63) Continuation-in-part of application No. 12/422,013, filed on Apr. 10, 2009, now abandoned.

(51) Int. Cl.
*E03D 9/04* (2006.01)

(52) U.S. Cl.
USPC ..... 4/213

(58) Field of Classification Search
USPC ..... 4/213, 216–217, 347–350
See application file for complete search history.

(56) References Cited

U.S. PATENT DOCUMENTS

| | | | | |
|---|---|---|---|---|
| 1,675,841 A | | 7/1928 | Cohoon | |
| 2,777,137 A | * | 1/1957 | McFadden | 4/213 |
| 3,942,200 A | | 3/1976 | Pearson | |
| 4,318,192 A | | 3/1982 | Williams et al. | |
| 4,494,255 A | * | 1/1985 | Drummond | 4/213 |
| 4,556,999 A | | 12/1985 | Lindley | |
| 4,989,276 A | | 2/1991 | Martens | |
| 4,998,299 A | | 3/1991 | Menge | |
| 5,123,125 A | | 6/1992 | Meng | |
| 5,167,039 A | | 12/1992 | Sim | |
| 5,231,705 A | | 8/1993 | Ragusa | |
| 5,353,443 A | | 10/1994 | Sim | |
| 5,386,594 A | * | 2/1995 | Hilton | 4/213 |
| 5,704,074 A | * | 1/1998 | Baldea | 4/213 |
| 5,715,543 A | | 2/1998 | Sim | |
| 5,906,009 A | | 5/1999 | Sakar | |
| 6,158,058 A | | 12/2000 | Martens | |

(Continued)

FOREIGN PATENT DOCUMENTS

| | | |
|---|---|---|
| CA | 2293817 | 12/1999 |
| CA | 2 368 941 | 10/2000 |

(Continued)

OTHER PUBLICATIONS

Partial European Search Report for EP 10159516.3.

*Primary Examiner* — Huyen Le
(74) *Attorney, Agent, or Firm* — Dority & Manning, P.A.

(57) ABSTRACT

A ventilated toilet includes a toilet bowl having flush holes disposed around a rim of the toilet bowl for discharging water into the toilet bowl, a holding tank for containing a volume of water sufficient to cause the toilet to flush when the volume of water is discharged into the toilet bowl, a flush and refill mechanism for flushing and then refilling the toilet, the flush mechanism controlling a flush valve that covers a drain in a bottom of the holding tank. The toilet also includes a water feed conduit connecting the drain to the holes around the rim of the bowl. A motion-sensitive switch is connected to a movable portion of the flush and refill mechanism for controlling an air ventilation fan that draws malodorous air from the toilet bowl through the flush holes and conduit and then through an air outlet in the toilet bowl.

19 Claims, 5 Drawing Sheets

(56) References Cited

U.S. PATENT DOCUMENTS

| | | | | |
|---|---|---|---|---|
| 6,219,853 | B1 * | 4/2001 | Johnson | 4/216 |
| 6,295,656 | B1 * | 10/2001 | Tillen | 4/216 |
| 6,694,534 | B2 | 2/2004 | Stone | |
| 6,775,853 | B1 * | 8/2004 | Szekely | 4/217 |
| 6,804,837 | B1 | 10/2004 | Guess, Sr. | |
| 2009/0044320 | A1 | 2/2009 | Abunameh | |
| 2009/0320194 | A1 * | 12/2009 | Lovatt | 4/237 |

FOREIGN PATENT DOCUMENTS

| | | | |
|---|---|---|---|
| CA | 2 325 759 | | 6/2002 |
| CA | 2 513 996 | | 1/2006 |
| DE | 4311066 | A1 | 9/1994 |
| DE | 9411849 | | 11/1994 |
| EP | 1041205 | A2 | 10/2000 |
| GB | 493200 | | 10/1938 |
| GB | 917933 | | 2/1960 |
| WO | 00/61883 | | 10/2000 |

* cited by examiner

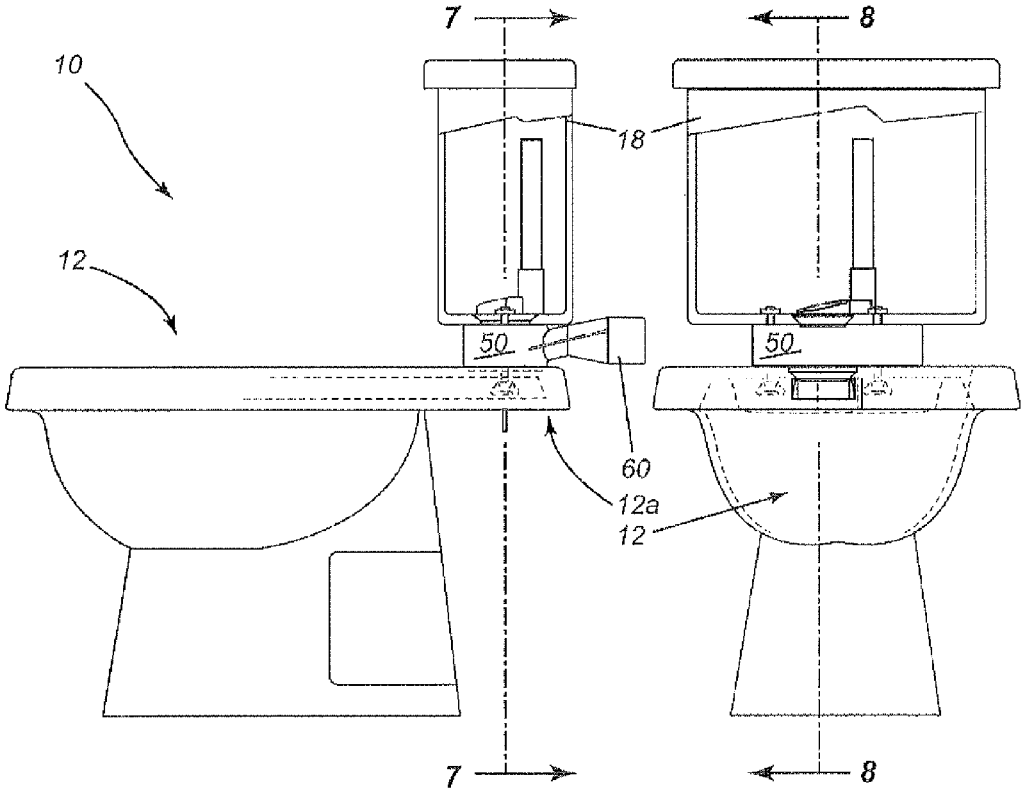
FIG. 5a
FIG. 5b
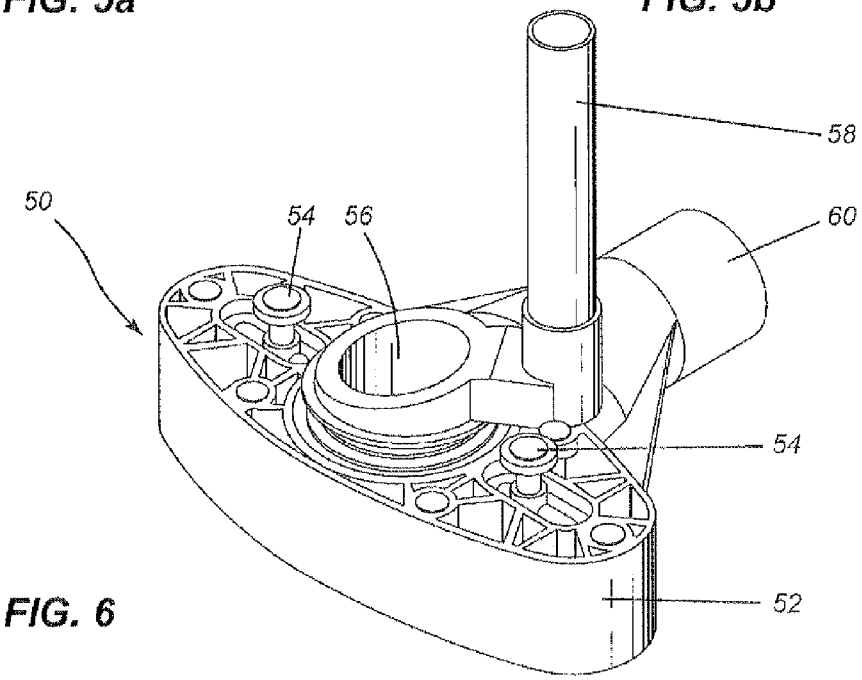
FIG. 6

VENTILATED TOILET

CROSS-REFERENCE TO RELATED APPLICATIONS

This application is a continuation-in-part of U.S. patent application Ser. No. 12/422,013 filed Apr. 10, 2009.

TECHNICAL FIELD

The present technology relates generally to toilets and, in particular, to ventilated toilets.

BACKGROUND

Flush toilets use water to dispose of human waste through a drain pipe into a sewer system. Exhausting malodorous air from a toilet is typically done using a ceiling-mounted fan. However, this is inefficient as the malodorous air must be drawn upwardly from the toilet to the fan on the ceiling. In recognition of this problem, a number of ventilated toilets have been developed for evacuating malodorous air in a more efficient manner. Generally, there are three types of ventilated toilets. A first type of ventilated toilet uses a filter or air scrubber to deodorize the malodorous air. The main disadvantages of this first type of ventilated toilet is that the filter or scrubber must be regularly replaced and that the deodorization effect may be ineffectual. A second type of ventilated toilet draws the malodorous air into the drain pipe and sewer. However, this can lead to back pressure especially in a septic system. Furthermore, if air is forced through the drain pipe and into the sewer, there would be no p-trap; as a consequence, there is no way to ensure that there is no back-drafting of sewage water. A third type of ventilated toilet uses a ventilation conduit to exhaust the malodorous air from the toilet. This requires retrofitting of after-market components. The present invention is an improvement on this third type of ventilated toilets. Although a number of different designs of ventilated toilets exist, they are typically complex and/or inefficient. Accordingly, a need remains for an improved ventilated toilet. There is also a need for a means to easily retrofit a standard toilet to convert the toilet into a ventilated toilet capable of efficient evacuating malodorous air.

SUMMARY

In general, the present invention provides a ventilated toilet that uses a motion-sensitive switch mounted to one movable element of the flush and refill mechanism in order to control an air ventilation fan. The motion-sensitive switch can be used to deactivate the fan when water is discharged through a water feed conduit from the holding tank into the toilet bowl. The conduit thus only conveys water when the toilet is flushed. At all other times, the conduit is filled with air. In other words, the conduit contains air prior to water being discharged through the conduit and again after the water is discharged through the conduit. The ventilated toilet makes use of this water feed conduit to draw malodorous air back through the holes in the rim of the toilet bowl and through this same conduit to an air outlet that is formed in the rear wall of the toilet bowl. The motion-sensitive switch ingeniously deactivates the fan (and thus the rearward suction of air) when the toilet is flushed, i.e. when water flows through the conduit. At all other times, the fan may operate to draw malodorous air from the toilet bowl through the conduit and the novel air outlet formed in the back of the toilet bowl.

Thus, a main aspect of the present invention is a ventilated toilet having a toilet bowl having at least one hole disposed around a rim of the toilet bowl for discharging water into the toilet bowl, a holding tank for containing a volume of water sufficient to cause the toilet to flush when the volume of water is discharged into the toilet bowl, a flush mechanism for flushing the toilet, the flush mechanism controlling a flush valve that covers a drain in a bottom of the holding tank, a refill mechanism for refilling the holding tank, a water feed conduit connecting the drain to the at least one hole disposed around the rim of the toilet bowl, and a motion-sensitive switch connected to a movable portion of the refill mechanism for controlling an air ventilation fan, the fan drawing malodorous air from the toilet bowl through the flush holes and the conduit and then drawing the malodorous air out of the toilet through an air outlet in the toilet bowl.

Another aspect of the present invention is a ventilated toilet having a toilet bowl having at least one hole disposed around a rim of the toilet bowl for discharging water into the toilet bowl, a holding tank for containing a volume of water sufficient to cause the toilet to flush when the volume of water is discharged into the toilet bowl, a flush mechanism for flushing the toilet, the flush mechanism controlling a flush valve that covers a drain in a bottom of the holding tank, a refill mechanism for refilling the holding tank, a water feed conduit connecting the drain to the at least one hole disposed around the rim of the toilet bowl, and a motion-sensitive switch connected to a movable portion of the flush mechanism for controlling an air ventilation fan, the fan drawing malodorous air from the toilet bowl through the flush holes and the conduit and then drawing the malodorous air out of the toilet through an air outlet in the toilet bowl.

Yet another aspect of the present invention is a fan adaptor for retrofitting a toilet to convert the toilet into a ventilated toilet. The adaptor has an adaptor body adapted to be disposed between a rear portion of a toilet bowl and a holding tank. The adaptor also has a flush valve subassembly having a drain and an upright pipe adapted to extend into the holding tank, the upright pipe being adapted to convey water from the holding tank to the drain. The adaptor further includes an air exhaust pipe in fluid communication with the drain to enable malodorous air from the toilet bowl to be drawn through the air exhaust pipe.

The details and particulars of these aspects of the invention will now be described below, by way of example, with reference to the attached drawings.

BRIEF DESCRIPTION OF THE DRAWINGS

Further features and advantages of the present technology will become apparent from the following detailed description, taken in combination with the appended drawings, in which:

FIG. 5*a* is a side elevation view of a ventilated toilet that has been retrofitted with a toilet fan adaptor in accordance with another embodiment of the present invention;

FIG. 5*b* is a front elevation view of the ventilated toilet retrofitted with the toilet fan adaptor;

FIG. 6 is a perspective view of the toilet fan adaptor;

It will be noted that throughout the appended drawings, like features are identified by like reference numerals.

DETAILED DESCRIPTION

In general, the present invention provides a ventilated toilet that uses a motion-sensitive switch mounted to one movable element of the flush and refill mechanism in order to control an air ventilation fan. The motion-sensitive switch can be used to deactivate the fan when water is discharged through a water feed conduit from the holding tank into the toilet bowl. The conduit thus only conveys water when the toilet is flushed. At all other times, the conduit is filled with air. In other words, the conduit provides a temporary passageway through which malodorous air may pass. The malodorous air may pass through the conduit either (i) before the water is discharged from the holding tank through the conduit into the bowl or (ii) after the water has been discharged through the conduit into the bowl. The ventilated toilet makes use of this water feed conduit to draw malodorous air back through the holes in the rim of the toilet bowl and through this same conduit to an air outlet that is formed in the rear wall of the toilet bowl. The motion-sensitive switch ingeniously deactivates the fan (and thus the rearward suction of air) when the toilet is flushed, i.e. when water flows through the conduit. At all other times, the fan may operate to draw malodorous air from the toilet bowl through the conduit and the novel air outlet formed in the back of the toilet bowl.

Figure 1A:
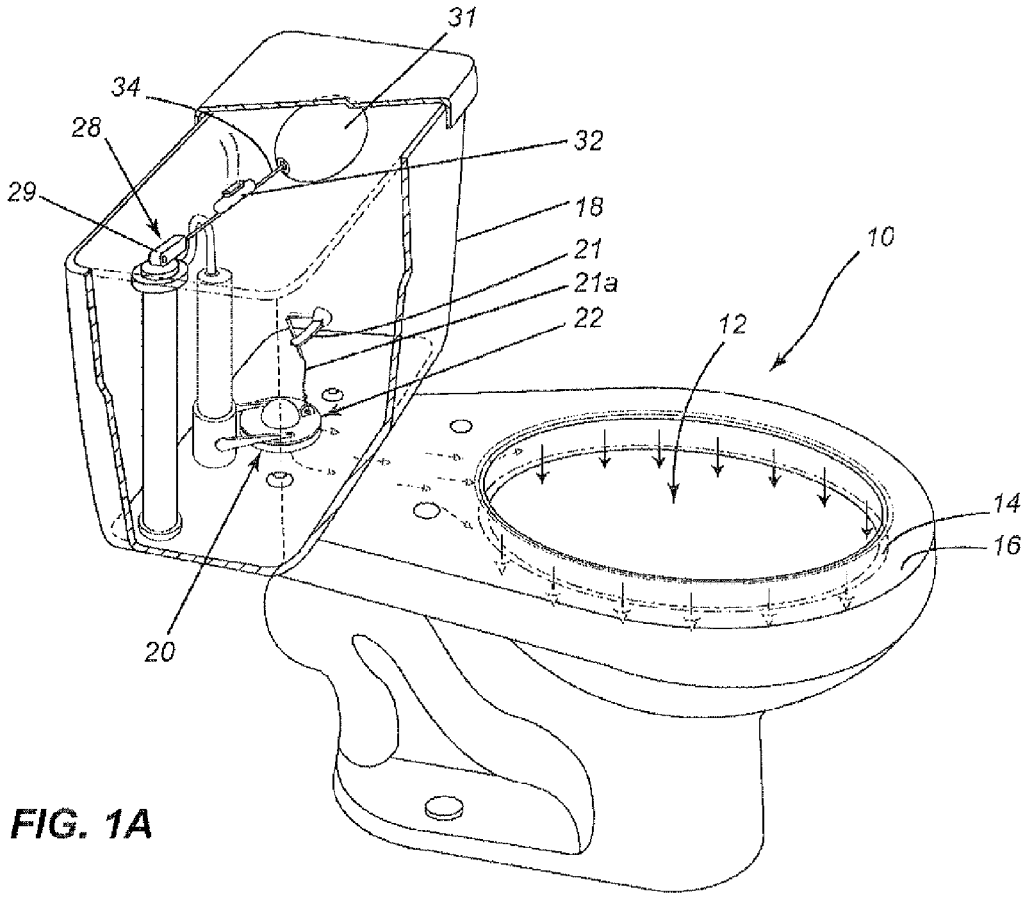
FIG. 1A is a perspective view of a ventilated toilet in accordance with an embodiment of the present invention.
Figure 1B:
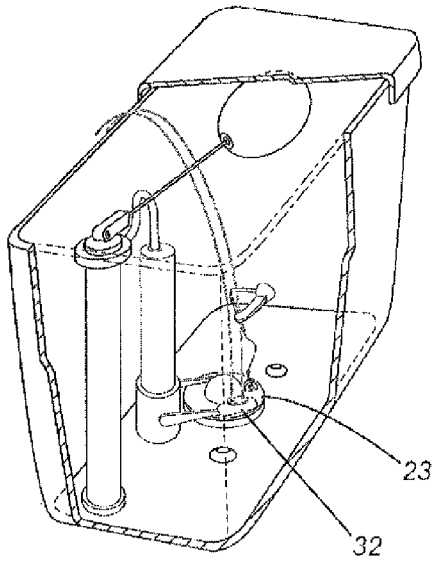
FIG. 1B is a perspective view of a ventilated toilet in accordance with another embodiment of the present invention.

As shown in FIG. 1A and FIG. 13, a ventilated toilet 10 comprises a toilet bowl 12 having at least one hole 14 disposed around a rim 16 of the toilet bowl for discharging water into the toilet bowl. The ventilated toilet also comprises a holding tank 18 for containing a volume of water sufficient to cause the toilet to flush when the volume of water is discharged into the toilet bowl. The ventilated toilet also includes a flush mechanism 20 for flushing the toilet, the flush mechanism controlling a flush valve 22 that covers a drain 24 in a bottom 26 of the holding tank. The flush mechanism may include, for example, a handle or flush lever 21 connected via a chain 21*a* to a flapper 23 (or "plunger"). Other flush mechanisms can be substituted. The ventilated toilet 10 further includes a refill mechanism 28 for refilling the holding tank after it has been emptied. The refill mechanism may include a refill valve 29, a float arm 34 and a float 31 or "floating ball" or "floating bulb"). The ventilated toilet further comprises a water feed conduit 30 (shown in FIG. 2) connecting the drain 24 to the hole(s) 14 disposed around the rim 16 of the toilet bowl 12. A motion-sensitive switch 32 (e.g. a mercury switch or equivalent) is connected to a movable portion of either the refill mechanism (such as the float arm 34 as shown in FIG. 1A) or to a movable portion of the flush mechanism (such as the flapper 23 as shown in FIG. 1B). This motion-sensitive switch 32 controls an air ventilation fan 36. When operating, the fan 36 draws malodorous air from the toilet bowl through the flush holes 14 and the conduit 30. The fan draws the malodorous air out of the toilet through an air outlet 38 which may be formed in the rear wall of toilet bowl. The motion-sensitive switch temporarily deactivates this fan to enable water to flow through the water feed conduit from the holding tank into the toilet bowl through a plurality of holes disposed around the rim of the bowl. When the water has passed through the conduit, the fan is reactivated to resume drawing air through the conduit into the ventilation duct. In other words, when air is being drawn or sucked from the toilet bowl, this air enters the holes around the rim of the bowl, travels through the substantially horizontal water feed conduit, and then out the rear aperture (air outlet 38) in the back wall of the toilet. Typically, the air is then drawn through one or more ventilation ducts 40, 42 in the wall and/or ceiling spaces.

FIG. 1A shows a first embodiment in which the motion-sensitive switch 32 is connected or attached to, or otherwise disposed on, an arm of a float, i.e. the float arm 34 which serves as the movable portion of the refill mechanism 28. For clarity, the float arm 34 extends between the refill valve 29 and the floating bulb 31. When the toilet is flushed, the float arm moves, thus triggering the motion-sensitive switch. The motion-sensitive switch cuts out the fan to allow water to pass through the water feed conduit. Once the volume of water from the holding tank has passed through this conduit, the switch moves back to its original (starting) position to thus reactivate the fan. Optionally, a delay circuit or timing circuit (or a delay mechanism) may be used to delay reactivation of the fan after a predetermined period of time after the switch is triggered or after a predetermined period of time after the switch has returned to its original, starting position.

FIG. 1B shows a second embodiment in which the motion-sensitive switch 32 is connected or attached to, or otherwise disposed on, a flapper 23 (also known as a flap or a plunger) that is the pivoting part of the drain valve 22. It is preferred to locate the switch 32 on the flapper 23 rather than locating the switch 32 on the float arm 34 since the flapper provides greater motion sensitivity and more directly indicates whether water is transiting the conduit.

As will be appreciated, other mechanisms, configurations or arrangements may be implemented for triggering the motion-sensitive switch. It should be understood that any suitable motion-sensitive switch may be connected to any component of the toilet that moves in response to flushing such as, for example, the handle (hand-operated flush lever), the lever that actuates the chain, the chain, the flapper, etc. Mechanisms can be devised to exploit the motion of any of these components to trigger the switch to deactivate the fan. In each of these alternative cases, the switch temporarily deactivates the fan while water flows through the water feed conduit and then reactivates the fan to draw air through this same conduit.

Figure 2:
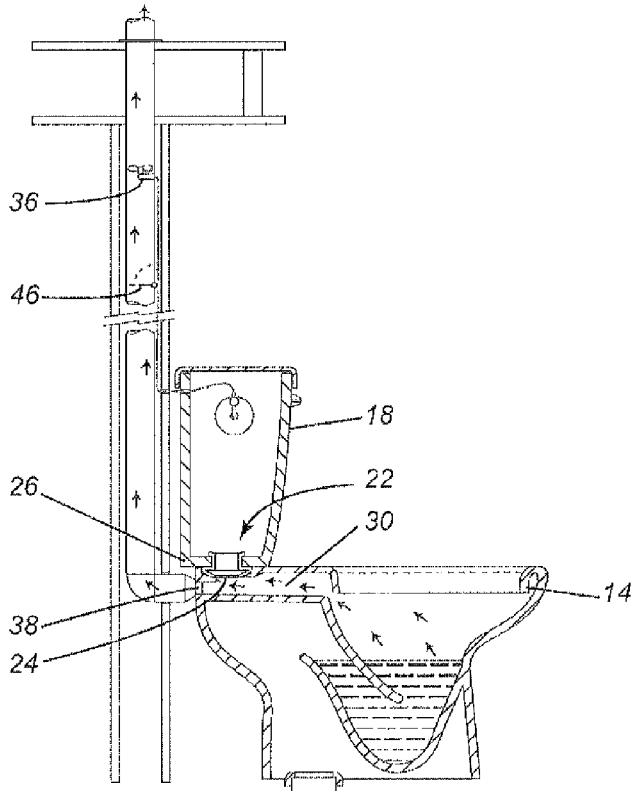
FIG. 2 is a side cross-sectional view showing a vertical ventilation pipe in a bathroom wall space connected to a ventilated toilet in accordance with embodiments of the present invention.

FIG. 2 is a side cross-sectional view showing a vertical ventilation duct 40 in a bathroom wall space connected to a ventilated toilet in accordance with embodiments of the present invention. In this example configuration, a fan may be disposed in a wall space or elsewhere to draw malodorous air from the ventilated toilet. Alternatively, the fan may be disposed between the air outlet at the rear of the toilet and the wall. In one embodiment, the fan may be wired into the wall switch circuit so that the wall switch acts as a master switch. On entering the bathroom, the user would turn on the wall switch to activate the fan. When the toilet is flushed, the motion-sensitive switch temporarily deactivates the fan. Once the motion-sensitive switch moves back to its original position, the fan reactivates. On leaving the bathroom, the user turns off the wall switch to shut off the fan.

Figure 3:
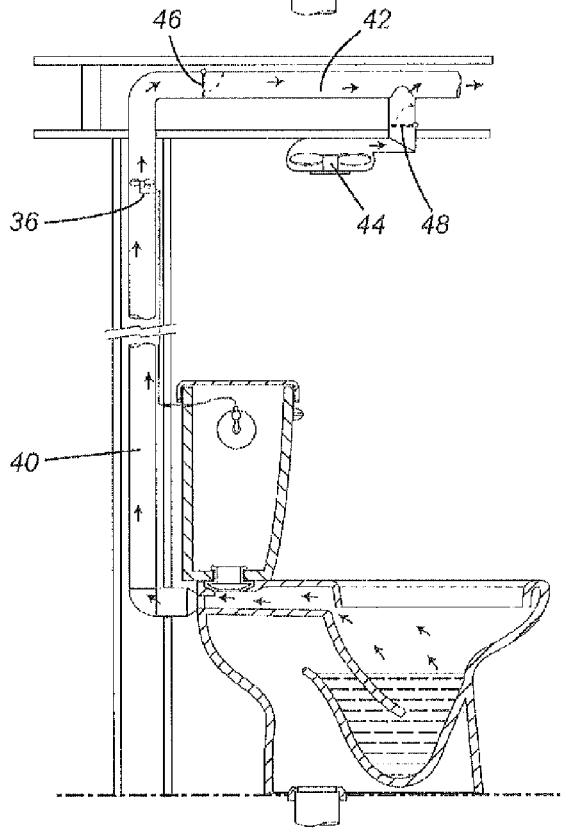
FIG. 3 is a side cross-sectional view showing a right-angled ventilation pipe in a bathroom wall space and ceiling space connected to a ventilated toilet in accordance with embodiments of the present invention.

FIG. 3 is a side cross-sectional view showing a right-angled ventilation duct in a bathroom wall space and ceiling space connected to a ventilated toilet in accordance with embodiments of the present invention. Malodorous air is drawn through ducts 40, 42 in this example. In this example configuration, a ceiling fan 44 draws air from the room in a conventional manner but also the effect of drawing some air through the air ventilation ducts 40, 42 leading from the ventilated toilet 10. An air flap valve 46 in the duct 42 should be provided to ensure that air sucked into the ceiling fan is not directed back down the duct 40 leading into the ventilated toilet. The suction power of the ceiling fan 44, however, is typically insufficient to effectively draw the malodorous air from the toilet. Accordingly, it is preferable to provide an additional fan 36 to draw malodorous air from the toilet 10 and to convey this malodorous air through the exhaust/ventilation ducts 40, 42 to the outdoors. A second flap valve 48 can be provided to ensure that malodorous air drawn through the ducts 40, 42 does not return into the bathroom through the ceiling fan (in cases where the ceiling fan is not also operating simultaneously with the fan 36).

Figure 4:
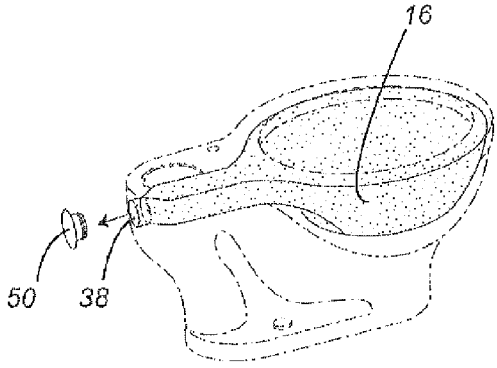
FIG. 4 is a partial cutaway view of a modified toilet bowl having a rear aperture and a removable plug that can be removed to enable connection of the toilet bowl to a ventilation pipe.

FIG. 4 is a partial cutaway view of a modified toilet bowl having a rear aperture defining an air outlet 38 and a removable plug 50 that can be removed to enable the ventilated toilet to be connected to the ventilation duct 40. The removable plug may be made of a plastic/polymer or other suitable material. The plug 50 may be installed using a gasket or other sealing element to ensure a hermetic fluid-tight seal. The plug may be connected into the rear aperture of the toilet using a press-fit or threads, for example. The plug enables the toilet to function conventionally if it is not connected to the ventilation duct for whatever reason.

In one embodiment, as illustrated by way of example in FIG. 4, the air outlet (rear aperture) 38 is disposed in the rear wall of the toilet bowl in substantial horizontal alignment with the conduit (water feed conduit 30). This simplifies construction and facilitates evacuation of malodorous air straight through the conduit into the ventilation duct.

The toilet bowl can be made of porcelain or other suitable ceramic material. A pivoting toilet seat and toilet seat cover are typically mounted to the toilet bowl in a known manner. The toilet seat and toilet seat cover are typically made of a plastic, for example, PVC, ABS or any other suitable polymer.

Another embodiment of this invention is an adaptor for retrofitting a standard flush toilet to enable efficient evacuation of malodorous air through this adaptor. This adaptor can be inserted between the toilet bowl and the tank as will be elaborated below with regard to FIG. 5*a* to FIG. 10.

FIG. 5*a* and FIG. 5*b* depict an adaptor 50 disposed between a standard toilet bowl 12 and a standard holding tank 18. The adaptor has the effect of raising the holding tank 18, as shown, but the tank and bowl remain operatively connected so that water from the holding tank can be discharged into the bowl to flush out the bowl in the usual manner. Just like the ventilated toilet depicted in FIG. 1 to FIG. 4, malodorous air can be drawn from the toilet bowl through an air exhaust (or air exhaust pipe or outlet).

The structure of the adaptor 50 is depicted by way of example in FIG. 6. In general, the adaptor 50 includes a body 52. This body may be solid, or partially hollow as shown. In the embodiment depicted in FIG. 6, the body 52 has an internal lattice or web structure to structurally support the holding tank 18. As such, the adaptor body is adapted to be disposed between a rear portion 12*a* of the toilet bowl 12 and the holding tank 18.

Fasteners 52 and 54 are provided to affix the tank 18 to the bowl 12. These fasteners 52, 54 are longer than the fasteners that are typically employed for connecting the tank to the bowl because these must also traverse the width of the adaptor 50. In the particular embodiment depicted in FIG. 6, the adaptor 50 includes a water conduit or passageway defining a drain 56 that is in fluid communication with an upright pipe 58 adapted to extend into the holding tank 18. The upright pipe is adapted to convey water from the holding tank to the drain. The drain 56 and pipe 58 together form a flush valve subassembly that is, in this exemplary embodiment, integrated into the adaptor 50.

FIG. 6 shows the sloped (angled) or "bevelled" drain 56 for interacting with a standard flapper for opening and closing the drain. As further depicted in FIG. 6, the adaptor 50 includes an air exhaust pipe 60 through which malodorous air may be drawn by a fan in a manner identical (or at least highly similar) to the technique described above. The air exhaust pipe is in fluid communication with the drain to enable malodorous air from the toilet bowl to be drawn through the air exhaust pipe.

As depicted in the specific embodiment shown in FIG. 6, the latticework or webbing inside the body 52 of the adaptor 50 provides a substantially flat underside and a substantially flat top side so that the holding tank rests stably on the top of the adaptor and so that the adaptor rests stably on the top of the rear portion 12*a* of the toilet bowl.

In the best mode known to the inventors of implementing this invention, this adaptor 50 may be made of SLA polycarbonate or any other equivalent or similar material. As will be appreciated, any other material that provides the requisite strength, durability, and resistance to corrosion and which permits the component to be manufactured inexpensively may be substituted.

Figure 7:
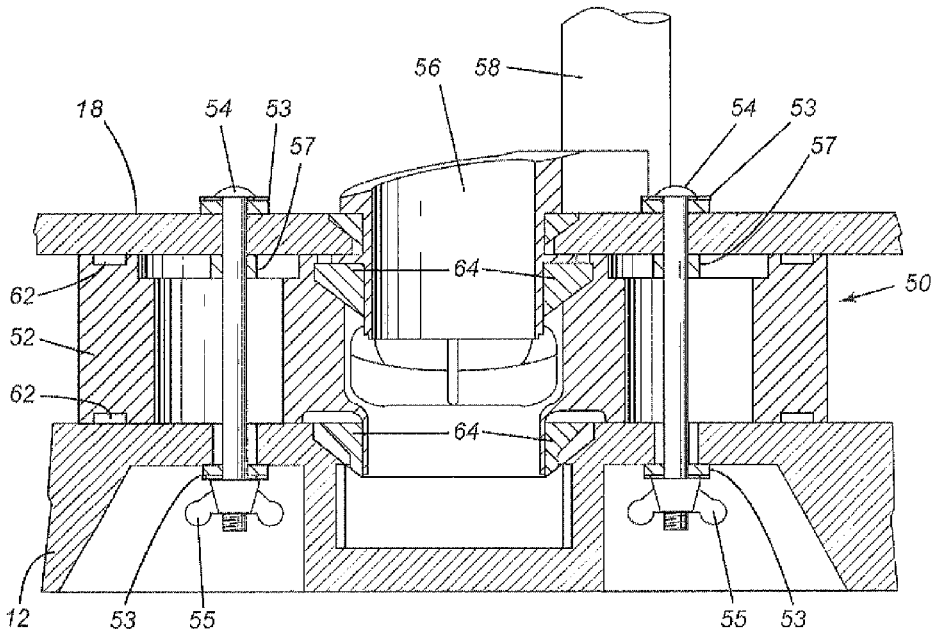
FIG. 7 is a cross-sectional view of the toilet fan adaptor between a standard toilet tank and toilet bowl, the cross-sectional view being taken through section 7-7 in FIG. 5*a;*

FIG. 7 is a cross-sectional view of the toilet fan adaptor 50 installed between a standard toilet tank 18 and a standard toilet bowl 12. The cross-sectional view is taken through section 7-7 in FIG. 5*a*. In the particular embodiment depicted by way of example in FIG. 7, the adaptor 50 includes (as introduced above) a pair of fasteners 52 and 54 for fastening the tank 18 to the bowl 12. These fasteners extend through the body 52 of the adaptor 50. These fasteners may be, for example, hex bolts although other types of fasteners may be used. Wing nuts 55 engage the bolts 52, 54 as shown in FIG. 7. As further shown by way of example in this figure, washer and foam disk gaskets 53 may be provided under the heads of the bolts 52, 54 and may also be provided above the wing nuts 55. In addition, as shown by way of example in FIG. 7, the adaptor 50 may include nuts 57 (e.g. hex nuts or other types of nuts) under the bottom of the tank 18. Elastomeric pads 62 may be provided as shown in FIG. 7. Furthermore, as shown by way of example in FIG. 7, standard toilet tank-to-bowl gaskets 64 may be provided to provide a watertight seal. These gaskets may be compressed in an interference fit to provide a proper seal.

Figure 8:
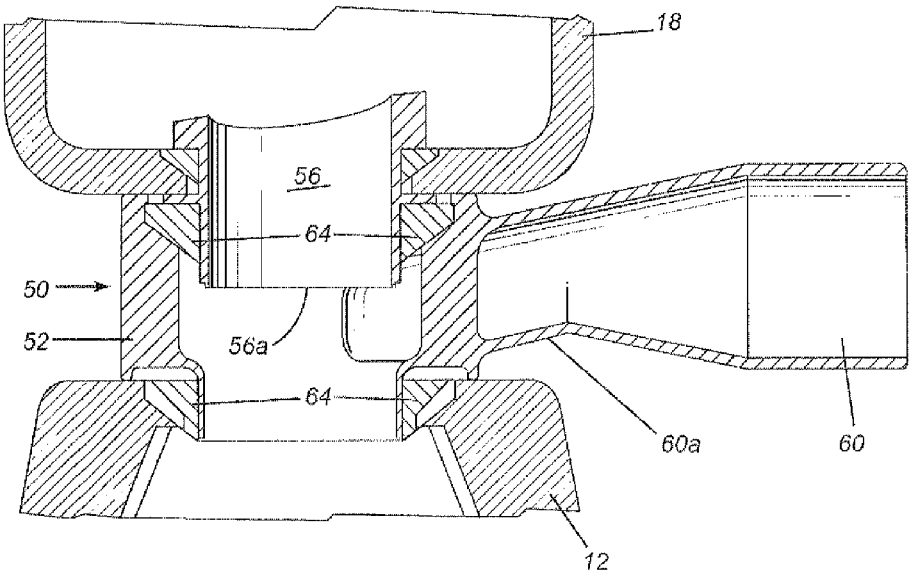
FIG. 8 is a cross-sectional view of the toilet fan adaptor between the toilet tank and toilet bowl, the cross-sectional view being taken through section 8-8 in FIG. 5*b;*

FIG. 8 is a cross-sectional view of the adaptor 50 installed between the toilet tank and toilet bowl as introduced in FIG. 7. However, the cross-sectional view for FIG. 8 is taken through section 8-8 in FIG. 5*b*. This figure shows the air exhaust pipe 60 extending outwardly from the adaptor body 52. This air exhaust pipe 60 communicates with the bowl 12 so that malodorous air may be drawn from the bowl through the air exhaust pipe 60. This cross-sectional view shows how the bottom end of the wall 56*a* of the drain 56 extends downwardly at least partially beyond the aperture leading to the air exhaust pipe 60. This prevents water discharging through the drain 56 from flowing accidentally up the air exhaust pipe 60. The air exhaust pipe 60 also has an upwardly sloped inlet portion 60*a* that inhibits water from flowing up into the air exhaust pipe 60.

Figure 9:
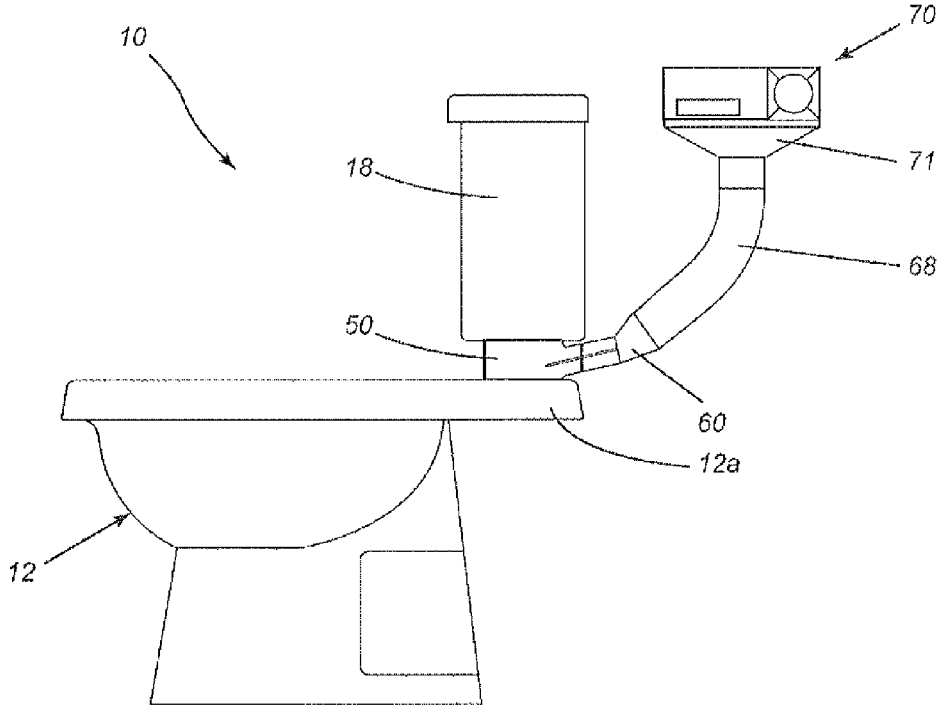
FIG. 9 is a side elevation view of the ventilated toilet retrofitted with the adaptor and connected to a first type of exhaust fan.
Figure 10:
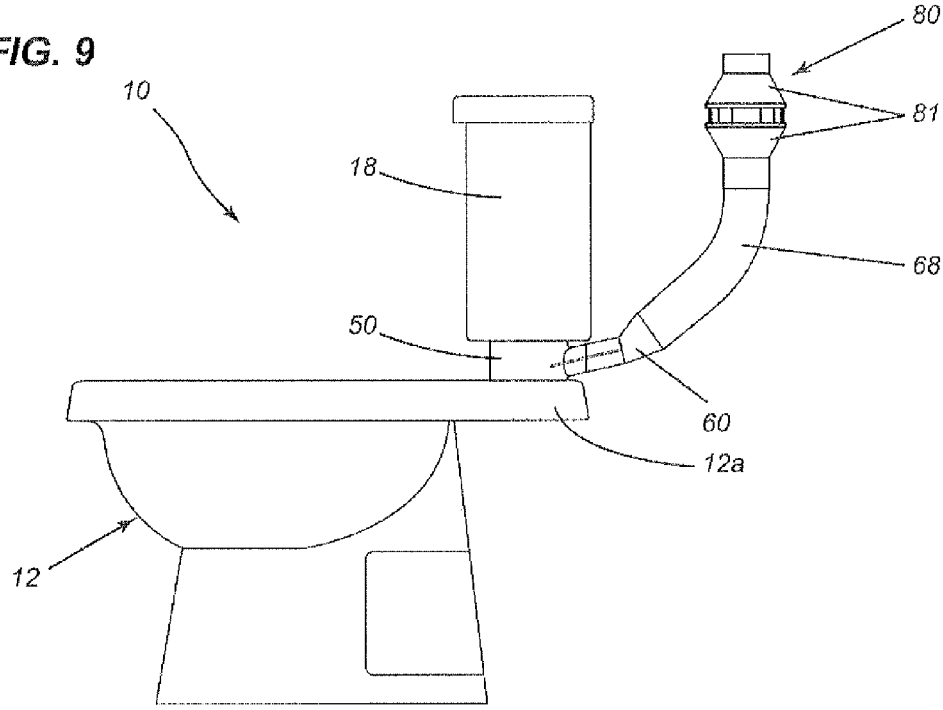
FIG. 10 is a side elevation view of the ventilated toilet retrofitted with the adaptor and connected to a second type of exhaust fan.

Once the adaptor is installed to retrofit a standard toilet (and thus convert it into a ventilated toilet), the air exhaust pipe is connected to a fan by a flexible duct as shown in FIG. 9 and FIG. 10. This enables the retrofitted toilet to draw malodorous air from the toilet bowl for exhausting through the air exhaust pipe, and then through the flexible duct and fan.

FIG. 9 is a side elevation view of the ventilated toilet 10 retrofitted with the adaptor 50 and connected to a first type of exhaust fan 70. The fan 70 can be connected to a flexible duct 68 by an exhaust fan adaptor 71. For example, this fan 70 can be a Panasonic WhisperFit™ FV-11VF2 (or equivalent). Assuming a 2-inch (5 cm) diameter air inlet, the estimated air suction created by this fan will be 74 CFM (2.2 cubic meters per minute). A variable speed controller can be added to change the volumetric air flow.

FIG. 10 is a side elevation view of the ventilated toilet 10 retrofitted with the adaptor 50 and connected to a second type of exhaust fan 80. The fan 80 can be connected to a flexible duct 68 via an exhaust case fan adaptor 81. For example, this fan may be an exhaust case fan such as, for example, a Scythe DFS123812-3000 (or equivalent). Also assuming a 2-inch (5 cm) diameter air inlet, the estimated air suction created by this fan will be 118 CFM (3.5 cubic meters per minute). A variable speed controller can also be added to change the volumetric air flow.

This new technology has been described in terms of specific examples, embodiments, implementations and configurations which are intended to be exemplary only. Persons of ordinary skill in the art will appreciate that obvious variations, modifications and refinements can be made without departing from the scope of the present invention. The scope of the exclusive right sought by the Applicant is therefore intended to be limited solely by the appended claims.

The invention claimed is:

1. A ventilated toilet comprising:

a toilet bowl having at least one hole disposed around a rim of the toilet bowl for discharging water into the toilet bowl;

a holding tank for containing a volume of water sufficient to cause the toilet to flush when the volume of water is discharged into the toilet bowl;

a flush mechanism for flushing the toilet, the flush mechanism controlling a flush valve that covers a drain in a bottom of the holding tank;

a refill mechanism for refilling the holding tank;

a water feed conduit connecting the drain to the at least one hole disposed around the rim of the toilet bowl;

a motion-sensitive switch connected to a movable portion of the refill mechanism for controlling an air ventilation fan, the fan drawing malodorous air from the toilet bowl through the flush holes and the conduit and then drawing the malodorous air out of the toilet through an air outlet in the toilet bowl; and an air exhaust pipe in fluid communication with the drain to enable malodorous air from the toilet bowl to be drawn through the air exhaust pipe, wherein the air exhaust pipe has an upwardly sloped inlet portion that slopes upwardly from a point below the drain to inhibit water from flowing up into the air exhaust pipe, wherein a bottom end of a wall of the drain extends downwardly partially beyond a top of an opening end of the air exhaust pipe.

2. The ventilated toilet as claimed in claim 1 wherein the air outlet is disposed in a rear wall of the toilet bowl in substantial horizontal alignment with the conduit.

3. The ventilated toilet as claimed in claim 1 further comprising a removable cap for hermetically plugging the air outlet when the ventilated toilet is not connected to an exhaust duct.

4. The ventilated toilet as claimed in claim 1 wherein the motion-sensitive switch is a mercury shut-off switch for deactivating the fan.

5. The ventilated toilet as claimed in claim 4 wherein the motion-sensitive switch comprises a delay circuit to delay reactivation of the fan after a predetermined period of time has elapsed.

6. The ventilated toilet as claimed in claim 5 wherein the motion-sensitive switch is connected in a circuit with a wall switch.

7. The ventilated toilet as claimed in claim 1 wherein the motion-sensitive switch is mounted to a float arm that extends between a refill valve and a float.

8. The ventilated toilet as claimed in claim 1 wherein the motion-sensitive switch comprises a delay circuit to delay reactivation of the fan after a predetermined period of time has elapsed.

9. The ventilated toilet as claimed in claim 1 wherein the motion-sensitive switch is connected in a circuit with a wall switch.

10. A ventilated toilet comprising:

a toilet bowl having at least one hole disposed around a rim of the toilet bowl for discharging water into the toilet bowl;

a holding tank for containing a volume of water sufficient to cause the toilet to flush when the volume of water is discharged into the toilet bowl;

a flush mechanism for flushing the toilet, the flush mechanism controlling a flush valve that covers a drain in a bottom of the holding tank;

a refill mechanism for refilling the holding tank;

a water feed conduit connecting the drain to the at least one hole disposed around the rim of the toilet bowl;

a motion-sensitive switch connected to a movable portion of the flush mechanism for controlling an air ventilation fan, the fan drawing malodorous air from the toilet bowl through the flush holes and the conduit and then drawing the malodorous air out of the toilet through an air outlet in the toilet bowl; and an air exhaust pipe in fluid communication with the drain to enable malodorous air from the toilet bowl to be drawn through the air exhaust pipe, wherein the air exhaust pipe has an upwardly sloped inlet portion that slopes upwardly from a point below the drain to inhibit water from flowing up into the air exhaust pipe, wherein a bottom end of a wall of the drain extends downwardly partially beyond a top of an opening end of the air exhaust pipe.

11. The ventilated toilet as claimed in claim 10 wherein the air outlet is disposed in a rear wall of the toilet bowl in substantial horizontal alignment with the conduit.

12. The ventilated toilet as claimed in claim 10 further comprising a removable cap for hermetically plugging the air outlet when the ventilated toilet is not connected to an exhaust duct.

13. The ventilated toilet as claimed in claim 10 wherein the motion-sensitive switch is a mercury shut-off switch for deactivating the fan.

14. The ventilated toilet as claimed in claim 10 wherein the motion-sensitive switch is affixed to a flapper covering the drain, the motion-sensitive switch being triggered when a chain connected to a flush lever causes the flapper to pivot to uncover the drain.

15. The ventilated toilet as claimed in claim 10 wherein the motion-sensitive switch is wired to act as a shut-off to deactivate the fan when the movable portion of the flush mechanism is moved.

16. The ventilated toilet as claimed in claim 10 wherein the motion-sensitive switch comprises a delay circuit to delay reactivation of the fan after a predetermined period of time has elapsed.

17. The ventilated toilet as claimed in claim 10 wherein the motion-sensitive switch is connected in a circuit with a wall switch.

18. A fan adaptor for retrofitting a toilet to convert the toilet into a ventilated toilet, the adaptor comprising:

an adaptor body adapted to be disposed between a rear portion of a toilet bowl and a holding tank;

a flush valve subassembly having a drain and an upright pipe adapted to extend into the holding tank, the upright pipe being adapted to convey water from the holding tank to the drain; and an air exhaust pipe in fluid communication with the drain to enable malodorous air from the toilet bowl to be drawn through the air exhaust pipe, wherein the air exhaust pipe has an upwardly sloped inlet portion that slopes upwardly from a point below the drain to inhibit water from flowing up into the air exhaust pipe, wherein a bottom end of a wall of the drain extends downwardly partially beyond a top of an opening end of the air exhaust pipe.

19. The adaptor as claimed in claim 18 further comprising a lattice structure and fasteners extending through the lattice structure for affixing the holding tank to the toilet bowl through the lattice structure.

* * * * *